United States Patent [19]

Burger

[11] 4,035,931

[45] July 19, 1977

[54] INTERCHANGEABLE LANE BOWLING CALCULATOR

[76] Inventor: Charles H. Burger, P.O. Box 86, Lovingston, Va. 22949

[21] Appl. No.: 734,061

[22] Filed: Oct. 20, 1976

[51] Int. Cl.[2] ..... A63B 69/00; G09B 9/00

[52] U.S. Cl. ..... 35/29 F

[58] Field of Search ..... 35/29 F

[56] References Cited

U.S. PATENT DOCUMENTS

| | | | |
|---|---|---|---|
| 2,942,358 | 6/1960 | Pomranz | 35/29 F |
| 2,989,810 | 6/1961 | Marting | 35/29 F |
| 3,012,339 | 12/1961 | Peterson | 35/29 F |
| 3,279,097 | 10/1966 | Tomblin | 35/29 F |
| 3,284,928 | 11/1966 | Kelley | 35/29 F |
| 3,455,032 | 7/1969 | Vail | 35/29 F |
| 3,995,377 | 12/1976 | Grollmusz | 35/29 F |

*Primary Examiner*—Harland S. Skogquist
*Attorney, Agent, or Firm*—David H. Semmes

[57] ABSTRACT

An improved form of bowling calculator which allows for interposition of either of two covers upon a main frame that carries bowling lane indicia. Each of the interchangeable covers includes an elastic member extending longitudinally within the cover with a plurality of adjustment means spaced along its length. Each cover is freely positionable upon the main frame by an access opening which fits over a registration pin extending upwardly from the surface of the main frame. With this improved device, a characteristic ball curvature may be defined for each of two distinct bowling lanes by individual adjustments of the elastic member within each of the covers, thereafter each cover may be interchanged upon the main frame as two bowling lanes are being used, for example as in tournament play. The present device allows the bowler to determine lane spots for each of two separate alleys, and adjust the elastic member on each of two covers so that he may more accurately determine a spot for each of two bowling lanes by reference to the habitual curvature the bowler has discovered for each of two bowling lanes.

10 Claims, 8 Drawing Figures

INTERCHANGEABLE LANE BOWLING CALCULATOR

BACKGROUND OF THE INVENTION

1. Field of the Invention

This invention relates to a calculator device which allows a bowler to predict spots on each of two bowling lanes by reference to an adjustable ball characteristic line as defined by two interchangeable covers. As is well-known, 10-pin bowling alleys include lane markers or "spots" positioned at various points along the elongate length of the alley. It is common for a bowler to select particular lane spots as an aiming device, so that the habitual curvature of that bowler, on that alley, will result in a final contact between a bowling ball and the bowling pins that is most effective for the situation. Each alley has characteristics peculiar to itself, and it is common for a bowler to adjust his orientation behind a foul line to most effectively match his characteristic ball curvature on that alley to the indicia upon the bowling lane.

The present invention is particularly directed to bowling as is done under tournament conditions, wherein a bowler necessarily transfers from a first lane to a second lane, and must develop a characteristic ball travel line for each of two lanes. The present invention, therefore, allows for the quick interposition of two superposed covers onto a frame carrying bowling lane indicia during a bowling exercise conducted on two lanes

BACKGROUND OF THE INVENTION

The present invention is considered a significant improvement over bowling calculator devices of prior art, as represented by the following U.S. Pat. Nos.

| | |
|---|---|
| KELLEY | 3,284,928 |
| TOMBLIN | 3,279,097 |
| PETERSON | 3,012,339 |
| KAMINSKY | 3,081,559 |
| MARTING | 2,989,810 |
| POMRANZ | 2,942,358 |
| HEKSTER | 2,800,279 |

The patents to Tomblin, Kelley, Peterson and Pomranz individually and collectively illustrate calculators allowing a bowler to reference a characteristic line of curvature for his bowling style to an actual bowling alley. However, none of these patents allow for a pair of superposed covers which may simply be inserted upon a main frame that carries indicia of the bowling lane, so that a separate line of travel may be established for each of two lanes, as normally used in competition bowling.

A positional bowling computer taught by the patent to Kelly employes a dial which is turned to line up an entry index for indicating a foot position to the bowler which will hopefully guide a ball into the strike zone. The patent to Tomblin employs a fixed plate which has a single curved line etched thereupon which is to be adjusted to match a ball curvature of a particular user. The device of Tomblin operates in a fashion analogous to the present invention, though the present invention employs a pair of superposed covers that allows for a developed ball curvature characteristic to be fixed within each of the covers, for each of two given lanes.

Peterson illustrates a bowling calculator device where the bowler's individual curvature is a fixed curve, without provision for adjusting the line curvature for various conditions of two distinct alleys, as proposed herein. Tomblin similarly includes an elongated member which is first referenced to a habitual bowler's curvature, and then moved over a member having bowling alley indica. Again, the patent to Pomranz does not allow for adjusting characteristics of the bowler's ball upon each of two superposed covers, with each of these two covers being quickly interchangeable upon the bowling lane indicia. The patents to Kaminsky, Marting and Hekster illustrate various other forms of calculator devices wherein a geometrical relationship may be established for given positions upon a frame having referencing indicia. Again, none of these patents contemplate a bowling calculator which includes a pair of covers for positioning over an elongated member having bowling lane indicia, wherein each cover includes an elastic member which may be adjusted and fixed for the ball characteristics of a bowler upon each of two bowling lanes.

SUMMARY OF THE INVENTION

The interchangeable lane bowling calculator herein comprises essentially three parts, a main frame which carries the registration pin, and includes an upper surface having bowling lane indicia visible thereupon, and a pair of transparent elongate cover assemblies which may be calibrated for ball characteristics on either of two bowling lanes.

The elongate main frame includes bowling lane indicia as is presently common in 10-pin bowling, with this indicia being minimally a transverse foul line, and a plurality of lane spots spaced longitudinally from the foul line. Additionally, the bowling lane indicia includes a plurality of bowling pin positions, conventionally referred to bowling pins 1–10, spaced at the other end of elongate main frame. This bowling lane indicia is standardized among various 10-pin bowling alleys, and is further illustrated, for example, in the above-discussed patent to Tomblin.

The present invention essentially includes two optically transparent elongate cover assemblies, each cover being structurally adapted for positioning upon the upper surface of the main frame. Each cover is essentially boxlike, and includes a recess on its underside which is adapted to receive a registration pin extending from the upper surface of the main frame. This recess allows for movement of the cover both longitudally and transversely with respect to the main frame, so that a given ball characteristic may be defined within the cover, and then adjusted relative to the bowling lane indicia on the surface of the main frame. An elastic member extends longitudinally within each of the first and second elongate covers and the elastic member has means for transverse position adjustment at a plurality of points which are spaced along the longitudinal extent of the elastic member. Thusly, the elastic member may be accurately configured to reflect the characteristic ball curvature of a bowler for each of two distinct bowling lanes, with this characteristic ball curvature remaining fixed relative to each of the covers. The adjustment is made, according to a preferred embodiment, by a series of transverse adjustment screws which connect to various longitudinal positions on the elastic member by a nut assembly. Each of the transverse adjustment screws itself may be adjusted within a longitudinal slot on each of the box-like covers, so that an accurate representation of a bowler's characteristic ball travel will be reproduceable, for each of two bowling lanes, within each of the box-like covers. In a preferred embodiment the upper surface of the elongate main frame includes a right circular cylinder form of registration pin, which fits into a circular access opening on the bottom of each of the box-like elongate covers. The diameter of the registration pin is less than the diameter of the circular access, so that the individual covers may be easily adjusted both transversely and longitudinally with respect to the upper surface on the main frame. The registration pin is itself positioned extending upwardly from the upper surface on the main frame at a longitudinal position which is approximately central to the bowling lane indicia on the main frame, or between the indicia for lane spots and the 10-pin positions. Consequently, each of the interchangeable covers may be quickly oriented in a pivotable fashion about the registration pin for accurately reflecting the spots on the bowling lane which will most effectively be aimed at by the bowler, for each individual lane, when attempting to upset particular bowling pins on each of two individual bowling alleys.

To most effectively reference the two interchangeable covers to the respective left and right bowling lanes being used during, for example, tournament bowling play, each of the interchangeable covers includes adjustment handles on opposite sides of the box-like transparent covers. To further fix the characteriatic ball curvature within each of the transparent covers, the preferred embodiment includes slide means attached to each end of the elastic member which is used to define the characteristic ball curvature for a given lane. The two slides are moveable transversely, at each end of the box-like transparent covers.

In a second preferred embodiment, the elongate main frame further comprises an upper surface of optically transparent plastic material, with the bowling lane indicia being printed upon a longitudinally extending optically opaque material which is spaced below and parallel to the upper surface of the main frame. In an alternate embodiment for this main frame, the present invention contemplates a form of elongate main frame which comprises a bottom surface that also has bowling lane indicia visible therethrough. In this embodiment the bottom surface also includes a second registration pin which is symmetrically placed and analogous to the first registration pin extending from the upper surface on the main frame. In this embodiment each of the elongate covers are adapted to be placed interchangeably upon either the upper surface or the bottom surface of the main frame, so that the bowler may simply flip over the main frame for referencing his characteristic ball curvature for each of two bowling lanes.

Therefore, it is a significant object of the present invention to provide a composite device which allows a bowler to quickly select one cover for each of two independent bowling lanes, as alternated between during tournament bowling play. The present invention significantly allows for a ball travel curvature to be fixed for each of these two lanes, within a given box-like transparent cover that includes an elastic member which is transversely adjustable at spaced longitudinal positions along its elongate length. The present invention allows the bowler to quickly interchange a cover, for each of two bowling lanes, without necessity for re-calibrating, or compensating for the previously determined ball characteristic which he has developed for each of the two individual bowling lanes.

Moreover, other features, objects and advantages of this invention will become more apparent by reference to the following detailed description, wherein reference is made to the accompanying drawings.

DETAILED DESCRIPTION OF THE INVENTION

Figure 1:
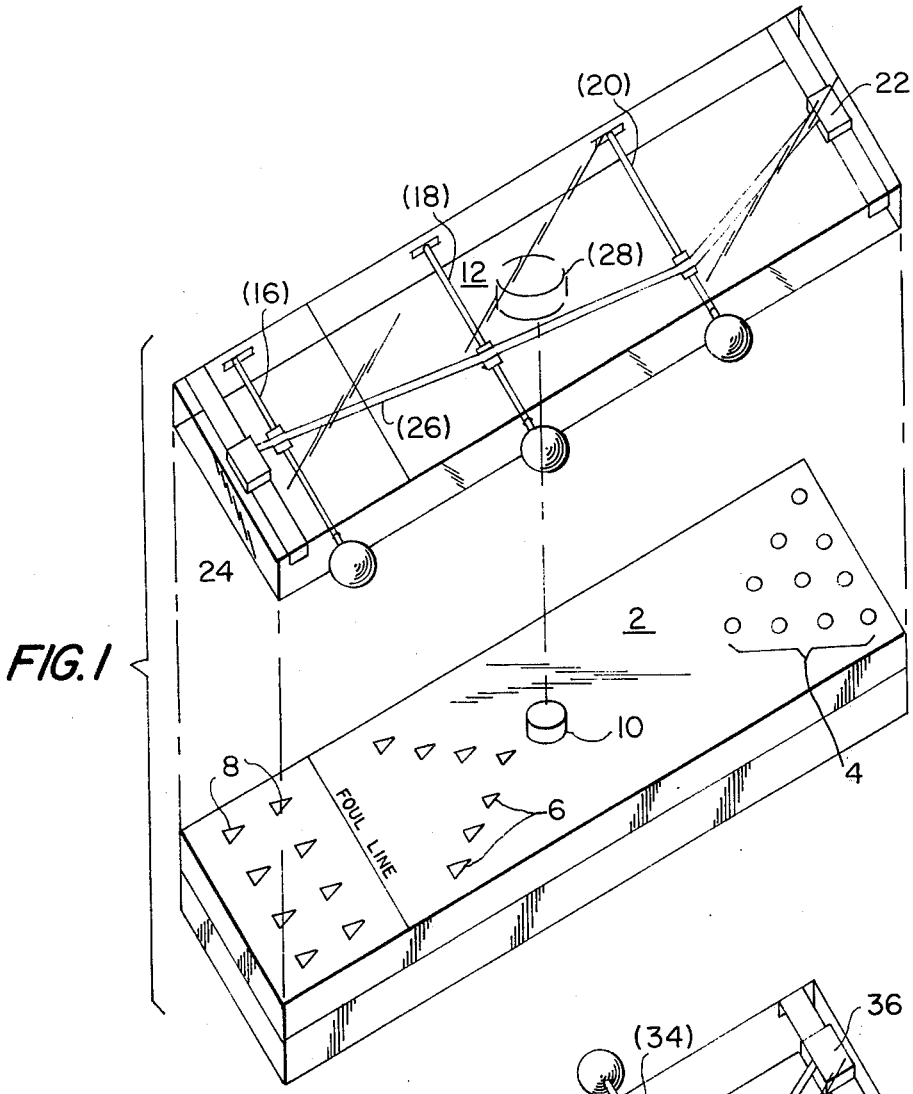
FIG. 1 illustrates a preferred form of the improved bowling calculator, with one of two superposed covers shown positioned over a main frame, in explosion view.

The present invention is an interchangeable lane bowling calculator that comprises three essential parts. In FIG. 1, an elongate main frame has an upper surface, 2, with powling lane indicia visible thereupon. For example, in 10-pin bowling there are 10 spots identified by the numeral 4, spaced as is known in a triangular fashion with pin number one closest to the other end of the bowling lane, and pin ten being in the farthest position away from the foul line, at the right side. The main frame upper surface 2 further includes a plurality of lane spots, 6 which similarly are longitudinally and transversely spaced across the bowling lane, closer to the foul line. Behind the foul line, are a plurality of ball delivery spots, 8, again as are conventionally found on bowling lanes. This bowling lane indicia is standardized for 10-pin bowling, and is further exampled in the above-descussed patent to Tomblin, for example.

Figure 2:
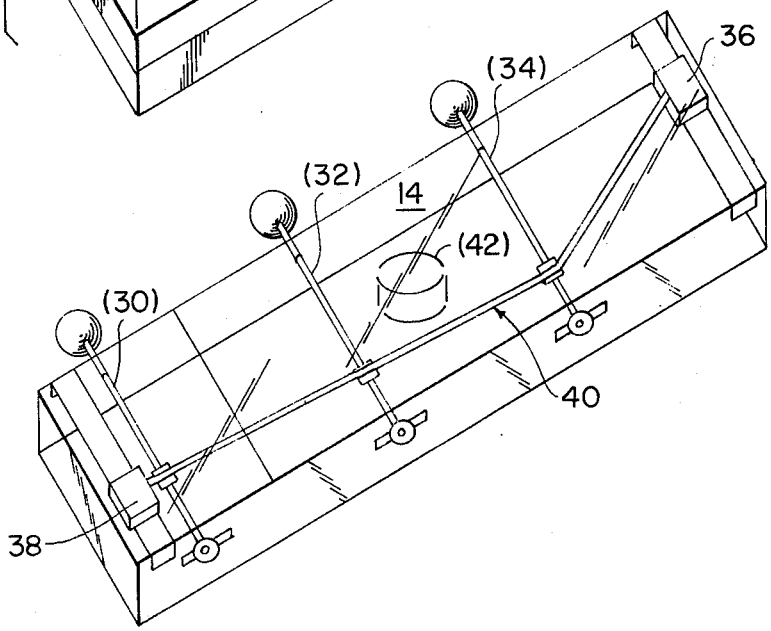
FIG. 2 illustrates in perspective view, a second cover which is usable upon the main frame in a manner illustrated for a first cover in FIG. 1.

As shown at FIG. 1, a second essential element of the invention is a superposed box-like cover 12, which is constructed or optically transparent material. This box cover 12 will hereinafter be referred to as the first cover, or a cover which may be adapted to a lane which is relatively right of a second lane being used, for example in tournament bowling play. An analogous, or left lane, superposed cover 14 is shown in FIG. 2. In FIG. 1, the first superposed cover 12 is shown in explosion view above the upper surface 2 of the main frame. Extending upwardly from the upper surface 2 is a registration pin 10, which in this preferred embodiment is a substantially right circular cylinder form. The registration pin 10 is adapted to move within a recess 28 on the underside of the first elongate cover 12. Each cover will receive the registration pin 10, and allow either cover to be adjusted both longitudinally and transversely with respect to the upper surface on the main frame. The first superposed cover 12, in FIG. 1, further significantly includes a first transversely extending screw 16. The first transverse screw 16 is proximate the foul line position, and allows for a transverse positioning of elastic member 26 with respect to the region on the main frame 2 which is proximate the ball delivery spots 8. A second transverse screw 18 allows for transverse adjustment of the elastic member 26 proximate the lane spots 6 appearing on the upper surface 2 of the main frame. A third transverse screw 20 is positioned on the box-like cover 12 between the registration pin 10 and the bowling pin positions shown at 4. The elastic member 26 is further transversely adjustable at a proximate end by a first transverse slide 24 which is attached to one end of the elastic member 26. At the distal end of the elastic member 26, there is a second transverse slide 22 to allow for an adjustment of the other end of the elastic member 26. Elastic member 26 may be comprised of rubber, and may be brightly colored to stand out against the indicia appearing on the upper surface 2 of the main frame when the cover is placed thereover. The first cover 12 may be conveniently distinguished from the second cover 14 by the fact that the transverse elastic member adjustment devices include adjusting handles that are positioned along the right side of the box-like cover. Similarly, the adjustment handles for each of the transverse screws on the second cover, for example for a left bowling lane, are on the opposite side to the handles on the first cover. By this structural adaptation, a bowler may establish a characteristic ball curvature within each cover without the confusion as to which cover is applicable to which lane.

The second cover 14, shown in FIG. 2, is completely analogous to the first cover 12 shown in explosion view on the main frame in FIG. 1. The second cover 14 includes a first transverse screw 30 proximate the ball delivery spots, a second transverse screw 32 proximate the lane spots, and a third transverse screw 34 between the registration pin and bowling pin positions on the cover 14. Additionally, the second cover 14 includes a first slide 38 proximate one end of the second elastic member 40, and a second slide 36 proximate the other end of the second elastic member 40. Hence, each cover allows a bowler to make a self-contained characteristic ball curvature, for each of two bowling lanes, and quickly interchange each cover upon the main frame as he switches from lane to lane, for example, during tournament bowling play. The second cover 14 includes a recess on its underside which is analogous to the recess 28 on the underside of the first cover 12.

Figure 3:
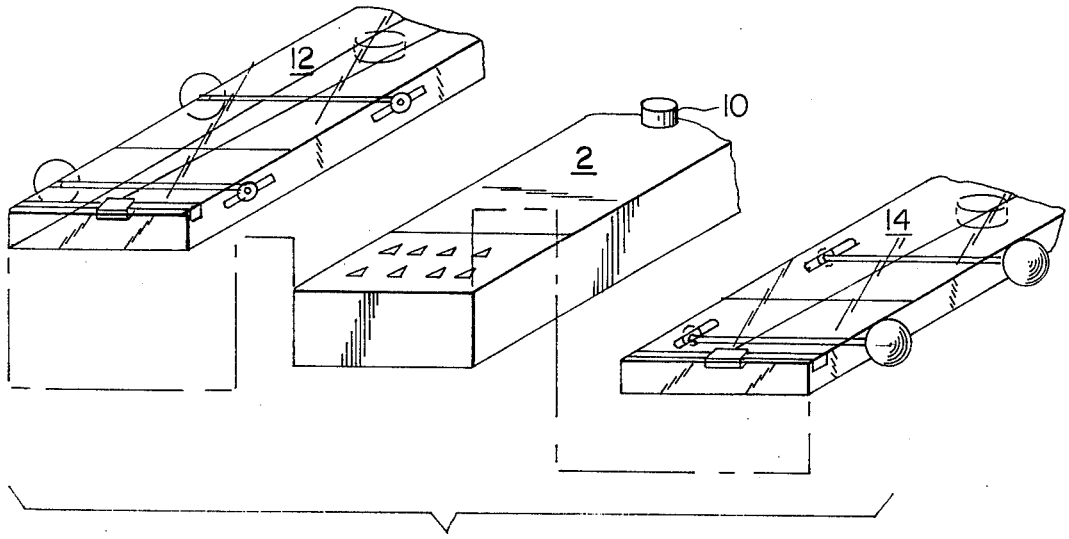
FIG. 3 illustrates in end plan view the combination of two covers and main frame which constitutes the present invention.

FIG. 3 illustrates the entire device to comprise a base unit together with a first cover, for example 12 usable for the left lane of a pair of bowling lanes, and a cover 14, interchangeable upon the base unit for a right lane of two bowling lanes.

Figure 4:
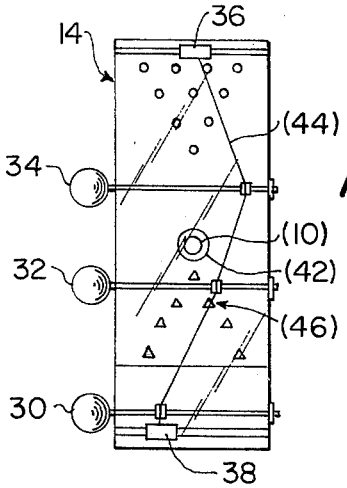
FIG. 4 and 5 illustrate use of the present invention with one of the superposed covers.
Figure 5:
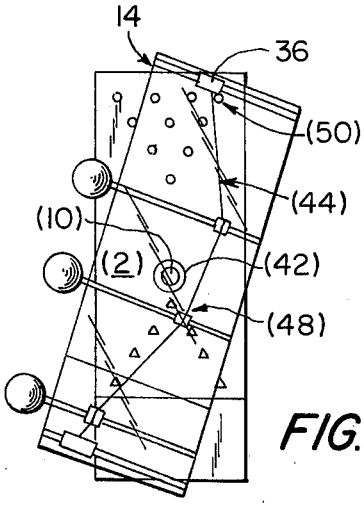

FIGS. 4 and 5 illustrate use of this device with the left lane cover 14 superposed upon the upper surface 2 of the main frame. During practice on a given bowling lane, the bowler adjusts the elastic member 40 into the curvature which most accurately reflects his characteristic ball on that particular lane, this curvature being shown set in FIG. 4 as position 44. As practice throws are made, the elastic member 44 is positioned by moving the first slide 38 and the second slide 36, with reference to the actual indicia on the bowling lane being used. Since characteristic ball curvature line 44 is one with a compound curvature, the present invention includes three transverse screws for repeating the ball curvature noted on the given bowling lane onto the superposed cover 14. Adjustment screw 30 may be positioned so that lane spot 46 will be coincident with the portion of the length of the charactistic elastic curved defined by the line 44, as it initially leaves the bowler's delivery point. The one end of the elastic member 44, as at the slide 38, may be conveniently referenced as to an initial ready position of the bowler, behind the foul line, as the bowler makes practice throws. Each slide is conveniently moved in a track spaced along the top of the cover, as shown at the ends of each cover. As the bowler makes practice throws, the second adjustment screw 32, and the third adjustment screw 34 may be turned to transversely position the elastic member 44 into the desired final configuration, with the distal end of the elastic member 44 being positioned as by the slide member 36. Having, therefore, mapped a curvature upon the cover 14, after a number of practice throws, the bowler may then freely pivot the first cover 12 relative to the registration pin 10, with his peculiar bowl line characteristic 44 remaining fixed relative to the first cover 14. As shown at FIG. 5, the characteristic line 44 has been pivoted so that the lane spot 48 is coincident with the characteristic ball travel line 44, and the 10 pin position, identified by numeral 50, has been lined up with the contact point of the far end of the characteristic line 44. In this fashion, the bowler may establish a characteristic line 44 for a given lane, such as a left bowling lane, and thereafter remove the left lane cover 14 and maintain this characteristic fixed within the box-like transparent cover 14. In like fashion, a characteristic line for the second, or right bowling lane may be developed and fixed within a second transparent box-like cover 12 for the right bowling lane, as used during tournament play. As noted above, each cover may be readily distinguished from the other, by the fact that the handles on the side of the box-like cover are oppositely spaced for each of the transparent covers, allowing quick identification of the cover to be placed upon the main frame for each individual bowling lane.

Figure 6:
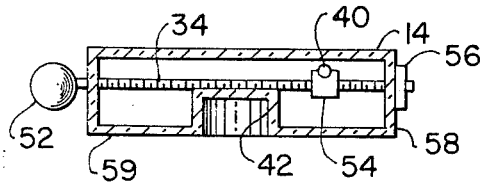
FIG. 6 is a detailed sectional view of one of the transparent box-like covers taught according to the principles of the present invention.

FIG. 6 illustrates, in sectional view, a cross-section of the box-like transparent cover 14, and is entirely analogous to the constructional details of the first transparent box-like cover 12. The third adjustment screw 34 is shown to have an adjustment handle 52 on the left side of the box-like cover, with the screw 34 extending parallel to the upper surface of the transparent plastic material comprising the cover 14. The screw 34 includes a nut, 54, and is rotatably mounted on the right side of the transparent cover, 58, as by a rotatable collar 56. The screw 54 is attached to the elastic member 40, for example, at its topside as shown in FIG. 6. As the handle 52 is rotated, the screw 54 will move transversely, and remain fixed until changed by rotation of the handle 52.

Figure 7:
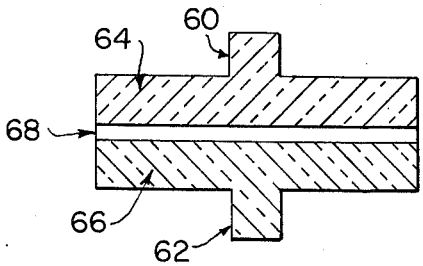
FIG. 7 illustrates a second embodiment for the main frame according to the principles of the present invention.

FIG. 7 illustrates a second embodiment for the main frame, and illustrates a main frame having both top and bottom surfaces which are further comprised of optically transparent material. The upper surface 64 includes a first registration pin 60, and the bottom surface 66 includes an analogous and symmetrically desposed registration pin 62. In between the optically transparent upper and lower surfaces, 64 and 66, respectively, there is a longitudinally extending and optically opaque material as shown at 68. This opaque material may be a printed sheet of material that is spaced parallel to both the top and bottom surfaces, and printed on each of its relatively upper and lower sides with the bowling lane indicia. The upper surface 64 and the lower surface 66 may also be preferably constructed of optically transparent plastic material. In this second embodiment, the first and second transparent elongate covers are adapted to be placed interchangeably upon either the upper surface 64 or the lower surface 66. For example, the first cover 12 may be positioned upon the upper surface 64, and the second cover 14 may be placed upon the lower surface 66, so that operation of the device requires merely flipping over the main frame for checking the relative orientation of a ball characteristic on each of two bowling lanes.

Figure 8:
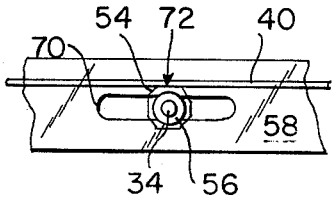
FIG. 8 illustrates a detail sectional view of the elastic member and one of its associated transverse position adjustment means.

FIG. 8 illustrates, in detail sectional view, the mounting of the third transverse screw 34 within a longitudinally extending slot 70 on the side of the transparent box-like cover 14. As shown in FIG. 6, the box-like cover includes a right side 58 and the slot 70 may be similarly provided for each of the two other transverse adjustment screws, to wit, 30 and 32. The screw 34 is longitudinally movable within the slot 70, by fraction engagement of the collar 56 against the side of the cover, 58. Extending proximate the top of the nut 54 is a connection point, 72, between the nut 54 and the elastic member 40. In this fashion, the relative longitudinal position of each of the transverse adjustment screws may be varied to better conform a characteristic curvature line for a bowling line of travel, for each of the two covers.

The present invention, therefore, constitutes a main frame having a pair of superposed covers that are interchangeable upon the main frame. Each cover allows for a characteristic line of travel for a bowling ball to be set within the cover, so that each cover may be quickly interchanged upon the main frame as a bowler alternates between two bowling lanes.

Having described the invention, and illustrated its used by preferred embodiments, it is to be understood that I intend my invention to be limited solely by the scope of the appended claims.

I claim:

1. An interchangeable lane bowling calculator device, comprising in combination:

A. An elongate main frame having an upper surface, with bowling lane indicia visible upon said upper surface, said indicia including a transverse foul line, and including a plurality of lane spots and a plurality of bowling pin positions both spaced longitudinally and transversely across said upper surface, wherein said foul line, lane spots and pin positions are respectively spaced longitudinally along said upper surface, a registration pin extending upwardly from said upper surface at a longitudinal position between said lane spots and said pin positions, and;

B. A first optically transparent elongate and box-like cover assembly adapted to be placed upon said upper surface, and including a recess on the underside of said cover adapted to receive said registration pin and allow for movement of said cover both longitudinally and transversely with respect to said main frame, and;

C. A second optically transparent elongate and box-like cover assembly adapted to be placed upon said upper surface, said second cover also including a recess as defined for said first elongate cover, and;

D. An elastic member extending longitudinally within each of said first and second elongate covers, said elastic member having a means for transverse position adjustment at a plurality of points spaced along its longitudinal extent, whereby a characteristic ball curvature may be defined for each of two distinct bowling lanes by separate adjustment of the elastic member within each of said covers, and said covers may be interchanged upon said elongate main frame carrying said bowling lane indicia.

2. An interchangeable lane bowling calculator device as in claim 1, wherein said registration pin is substantially a right circular cylinder and each of said recesses is of a cylindrical configuration with a diameter greater than the diameter of said registration pin.

3. An interchangeable lane bowling calculator device as in claim 1, wherein said elastic member transverse adjustment means comprises a first transverse screw proximate said foul line position, a second transverse screw proximate said lane spots, and a third transverses screw between said registration pin and bowling pin positions, wherein said elastic member is respectively attached to nuts adapted for transverse position adjustment upon each of said transverse screws.

4. An interchangeable lane bowling calculator device as in claim 3, wherein each of said elastic member transverse adjustment means further includes a first transverse slide attached to a proximate end of said elastic member and a second transverse slide fixed to a distal end of said elastic member.

5. An interchangeable lane bowling calculator device as in claim 4, wherein each of said first slides is proximate a first end of each of said elongate covers, and each of said second slides is proximate a second end of each of said elongate covers.

6. An interchangeable lane bowling calculator device as in claim 3, wherein said first elongate cover includes adjustment handles for each of said transverse screws on one side thereof, and said second elongate cover includes adjustment handles for each of said transverse screws on a side relatively opposite to said handles on said first cover.

7. An interchangeable lane bowling calculator device as in claim 1, wherein said elongate main frame further comprises an upper surface of optically transparent material and said bowling lane indicia is printed upon a longitudinally extending and optically opaque material spaced below and parallel to said upper surface.

8. An interchangeable lane bowling calculator device as in claim 7, wherein said optically transparent first surface and each said optically transparent covers are comprised of a transparent plastic.

9. An interchangeable lane bowling calculator device as in claim 1, wherein said elongate main frame further comprises a bottom surface with bowling lane indicia visible thereupon and a second registration pin as defined for said upper surface, wherein said first and second transparent elongate covers are adapted to be placed enterchangeably upon either said upper surface or said bottom surface.

10. An interchangeable lane bowling calculator device as in claim 9, wherein said top and bottom surfaces are further comprised of optically transparent material and are separated by a longitudinally extending and optically opaque material, said opaque material being mutually parallel to said top and bottom surfaces and printed on each of its relatively upper and lower sides with said bowling lane indicia.

* * * * *